United States Patent [19]

Gjosteen et al.

[11] 4,049,248

[45] Sept. 20, 1977

[54] DYNAMIC VACUUM TREATMENT

[75] Inventors: Ole Georg Gjosteen; Trygve Olavson Terum; Aksel Ola Aarflot, all of Sunndalsora, Norway

[73] Assignee: A/S Ardal og Sunndal Verk, Oslo, Norway

[21] Appl. No.: 541,273

[22] Filed: Jan. 15, 1975

Related U.S. Application Data

[60] Division of Ser. No. 496,859, Aug. 12, 1974, Pat. No. 3,895,937, which is a continuation-in-part of Ser. No. 269,086, July 5, 1972, abandoned.

[51] Int. Cl.[2] ..... C21C 1/00

[52] U.S. Cl. ..... 266/202; 164/254

[58] Field of Search ..... 13/31; 75/49; 266/34 V, 266/202, 207, 208, 211, 215, 216; 164/61-65, 253-258, 266, 281

[56] References Cited

U.S. PATENT DOCUMENTS

| | | | |
|---|---|---|---|
| 2,859,262 | 11/1958 | Harders et al. | 164/256 |
| 2,865,068 | 12/1958 | Dunn | 164/266 |
| 3,116,998 | 1/1964 | Pagonis | 266/34 V |
| 3,116,999 | 1/1964 | Armbruster | 75/49 |
| 3,137,566 | 6/1964 | Thieme | 75/49 |
| 3,201,105 | 8/1965 | Miller | 266/202 |
| 3,211,545 | 10/1965 | Sickbert | 75/49 |
| 3,384,362 | 5/1968 | Philbrick | 266/34 V |
| 3,408,059 | 10/1968 | Hornak | 266/34 V |
| 3,479,022 | 11/1969 | Coupette | 75/49 |
| 3,718,175 | 2/1973 | Rinesch | 164/254 |

FOREIGN PATENT DOCUMENTS

| | | | |
|---|---|---|---|
| 683,996 | 6/1930 | France | 75/49 |
| 918,574 | 2/1947 | France | |
| 1,386,389 | 3/1965 | France | 164/65 |
| 951,199 | 3/1964 | United Kingdom | 75/49 |

*Primary Examiner*—Roy Lake
*Assistant Examiner*—Paul A. Bell
*Attorney, Agent, or Firm*—Wenderoth, Lind & Ponack

[57] ABSTRACT

Method and apparatus for producing light metal alloys, in particular aluminum alloys, in which the desired alloying elements are first introduced into a vacuum furnace which is then evacuated, whereafter light metal melt is introduced into the furnace chamber by suction in the form of a free-falling metal jet which is thereby subjected to a vacuum treatment for reducing the contents of impurities, such as hydrogen, sodium, oxides and other non-metallic particles, therein. The free-falling metal jet is given such a configuration with respect to composition and flow pattern, such an average length as well as such velocity and direction that the alloying elements are readily dissolved and mixed into the melt in the vacuum furnace, whereby an alloy of desired quality is ready for casting immediately after termination of the vacuum treatment and alloying process.

11 Claims, 3 Drawing Figures

DYNAMIC VACUUM TREATMENT

This is a division of application Ser. No. 496,859 filed Aug. 12, 1974, now U.S. Pat. No. 3,895,937, which is a continuation-in-part of application Ser. No. 269,086, filed July 5, 1972, now abandoned.

BACKGROUND OF THE INVENTION

This invention relates to a method for use in producing light metal alloys, in particular aluminum alloys with elements which are commonly known to be alloyable to aluminum, as for instance Mg, Si, Fe, Mn etc. In this method a melt is vacuum treated and alloyed and at the same time the content impurities therein, such as sodium, hydrogen, oxides and other non-metallic particles, are effectively reduced. At the same time the melt can also be grain refined. The invention also comprises an apparatus for carrying out the method.

In recent years there has been in the aluminum market a steadily increasing demand for high speed extrudable alloys and rolling alloys, including a number of special alloys having particular requirements, for instance alloys with qualities such as high brilliancy after anodizing, the latter alloy being among others characterized by a low content of iron.

When producing aluminum alloys for casting in the form of "quarter finished products" as for instance direct chilled cast rolling ingots, extrusion billets and wire ingots, the actual alloying work compared to the production of plain aluminum, i.e. aluminum alloyed with only Fe and Si, involves reduced productivity and capacity with melt treatment methods being now employed.

Another disadvantage with this alloy production is that the alloying elements are usually introduced into the melt, which is stirred by hand or mechanically, by means of various tools which then contaminate the melt (confer the properties of the various materials or metals to the aluminum melt).

In the aluminum industry there is a further requirement for purifying or refining the raw metal, depending upon the fields of use for which the same is intended. In particular it is necessary in many instances to reduce the contents of sodium, finely dispersed oxide and other non-metallic particles from the aluminum melt at the same time as hydrogen is degased from the melt. In the production of several alloys it is absolutely necessary to carry out such purification.

SUMMARY OF THE INVENTION

The main object of this invention is to provide a new method with a corresponding apparatus for use on an industrial scale in a practical and effective manner to be able to reduce the contents of the above mentioned impurities at the same time as the melt, such as aluminum, is alloyed, by any of the known alloys, to the desired alloy quality, during which time there may also take place a grain refining process as well.

The method and apparatus of the invention make possible the production of light metal alloys, for instance aluminum wrought alloys or aluminum casting alloys, of high quality in a practical manner. The method is in practice primarily related to a particular utilization of vacuum techniques in the melt treatment of aluminum. Although the following description mainly will apply to the treatment of aluminum, it is obvious that this invention can also be employed in connection with the production of other light metals and their alloys.

From French patent specification No. 918,574 it is known that aluminum melt can be degassed whereby the melt is drawn or sucked in the form of a jet into a vacuum chamber or furnace. The theory has been that a quicker and more effective degassing can be obtained than is possible with vacuum treatment of a "stationary" melt. This has been explained in that the metal jet or spray has a low static fluid pressure and a large surface area compared with a stationary melt bath in industrial furnaces in which the metal surface area is relatively small and in which the static fluid pressure increases with increasing depth and thereby makes degassing of the melt difficult and at a certain critical distance from the surface completely prevents degassing thereof.

In the principle of the invention these relationships will have a practical effect. It will appear from the description to follow, however, that the degassing effect and the purification effect are generally to a large extent determined by the jet flow pattern which is specific and can assume several different and complex shapes which are a function of various conditions to be explained more closely below.

The conventional method of vacuum treatment of aluminum melt on an industrial scale consists in the introduction of molten aluminum charge by charge into a vacuum furnace which after the introduction of the aluminum melt is evacuated to the desired vacuum and is maintained in this condition until the charge of molten aluminumm has to a desirable or attainable degree been delivered from those substances or impurities which are to be removed. The conventional method, however, has short-comings, in the first place because the attainable degree of purification does not always correspond to that which is necessary or desirable, and in the second place because the time of the treatment is so long that the production capacity is comparatively low and the production expenses correspondingly high.

In experiments it has been shown that in vacuum jet degassing of aluminum melt the metal jet in vacuum will have a varying, but characteristic shape and "composition" determined by a number of different controllable factors.

In general the metal jet or spray is composed of two zones: (a) a central zone in which the metal is mainly in the form of metal foam, and (b) an outer zone in which the metal is in drop form.

The distribution of the metal volume in these two zones varies with: (a) the pressure in the vacuum chamber, (b) the content of gases in the metal, (c) the diameter, the length and the shape of the suction tube, and (d) the flow velocity in the jet determined by the factors (a) pressure in the vacuum chamber and (c) diameter length and shape of the suction tube. Usually more than 90% of the metal will be in the central zone. The diameter of the central zone increases with increasing distance from the suction opening, which means that the weight of aluminum metal per unit volume in the central zone decreases comparatively strongly with distance from the suction opening, i.e. the porosity of the metal foam increases. This implies further than the ratio between metal surface area and metal weight increases strongly with increasing distance from the suction opening, i.e. the exposed surface of the metal to vacuum (degassing surface) increases with increasing distance from the suction opening. For instance the weight of aluminum melt per unit volume at — (a) a certain gas content, (b)

a certain nozzle shape, and (c) a pressure of 1 Torr, can have an order of magnitude of 0.0006 g/cm³ at a distance of 100 cm from the suction opening, i.e. with more than 99% of the volume of the central zone consisting of gas. Under these circumstances the metal jet will be more like a spray. In vacuum jet degassing of aluminum melt as discussed above, the degassing is therefore particularly effective compared to vacuum treatment of a stationary melt and also compared to a number of other known degassing processes for aluminum melt.

As with a static vacuum treatment, it is difficult to imagine that a homogeneous nucleus formation of bubbles takes place. The nucleus formation of bubbles has a heterogeneous nature, the nucleus formation of the bubbles taking place (a) on the walls in the suction opening, (b) on the refractory liner in the transfer channel, and (c) on non-metallic particles in the metal jet itself. Thereby there will also be obtained a reduction of these impurities by flotation thereof out of the melt. In addition to this degassing from the jet itself in the chamber there is a simultaneous degassing from the melt bath.

By suitable arrangement of the suction device it is possible by means of the jet to bring about a strong stirring of the melt bath, and as a sufficient number of bubble nuclei are generated in the central zone of the jet and introduced into the bath, they provide for increased mass transport of impurities to the surface thereof. This jet shape leads to a core in the central zone of more compact consistency, i.e. the porosity of this "core" is substantially lower than in the remaining part of the central zone. Turbulence in the jet results in the "core" in the central zone also being exposed to vacuum, and both the degassing and the purifying effect is maintained by giving the metal jet a certain average length during the vacuum treatment.

By taking measures such (a) that the average length is close to the minimum magnitude for optimum treatment, (b) that the jet forms a small angle to the horizontal plane, and (c) that the direction of the jet in the horizontal plane is adjusted, there is obtained a strong circulation in the melt bath during the vacuum treatment. Experiments have shown that this circulation of the melt under vacuum increases the purification effect with respect to the contents of non-metallic particles, this purification effect being clearly an agglomeration effect.

An important aspect per se of this invention is the removal of oxides and other non-metallic particles from the metal melt by means of the vacuum treatment described.

By carrying out the vacuum jet treatment according to the method described above, it has been shown by experiments that a number of alloying elements commonly used for aluminum, such as Mg, Fe and Si, can be alloyed into the melt when these elements in pure form are brought into the empty vacuum chamber or furnace before the start of the vacuum treatment. It is to be understood that these specifically mentioned alloying elements are exemplary only. Many other elements are known by those skilled in the art to be used in aluminum alloying, and the invention extends to all other such commonly known alloying elements. The intense stirring performed by the metal jet increases the rate of dissolution of the alloying elements at the same time as these elements during dissolving thereof will be very thoroughly mixed into the melt. Addition of a grain refiner is made in the same way.

The primary object of the method of the present invention is to effectively reduce the content of impurities such as hydrogen, sodium and non-metallic particles in the melt at the same time as the melt is alloyed to the desired alloy quality.

For those alloys requiring a low sodium content, for instance AlMg5 (5% Mg), there have been developed methods of introducing a non-reactive gas, for instance argon, through the suction opening and/or through the melt bath itself under vacuum. The gas introduced mainly serves as a transport gas for vaporized sodium.

The above specific utilization of vacuum techniques, in which the aluminum melt is degassed and purified as far as non-metallic impurities and sodium are concerned, at the same time as the melt is alloyed and a possible grain refiner is added thereto, has been designated a dynamic vacuum treatment.

More specifically then the method of producing light metal alloys, in particular aluminum alloys, according to this invention is characterized in that the desired alloying elements are first introduced into a vacuum furnace which is then evacuated, whereafter light metal melt is introduced into the furnace chamber by suction in the form of a free-falling metal jet thereby being subjected to a vacuum treatment for reducing the content of impurities such as hydrogen, sodium, oxides and other non-metallic particles therein, and that the free-falling metal jet is given such a configuration with respect to composition and flow pattern, such an average length as well as such velocity and direction that the alloying elements are readily dissolved and mixed into the melt in the vacuum furnace, whereby an alloy of desired quality is ready for casting immediately after termination of the vacuum treatment and alloying process. By the term "free-falling" it is meant that the metal jet passes into and through the interior of the chamber without obstruction, i.e. the metal is not merely poured into the chamber, nor does it cascade over baffles.

An apparatus for carrying out this new method is according to the invention characterized that the vacuum chamber is provided with one or more nozzles for sucking molten metal into the chamber in the form of one or more jets.

BRIEF DESCRIPTION OF THE DRAWINGS

In the following description the invention shall be explained more in detail with reference to the drawings in which.

DETAILED DESCRIPTION OF THE INVENTION

Figure 1:
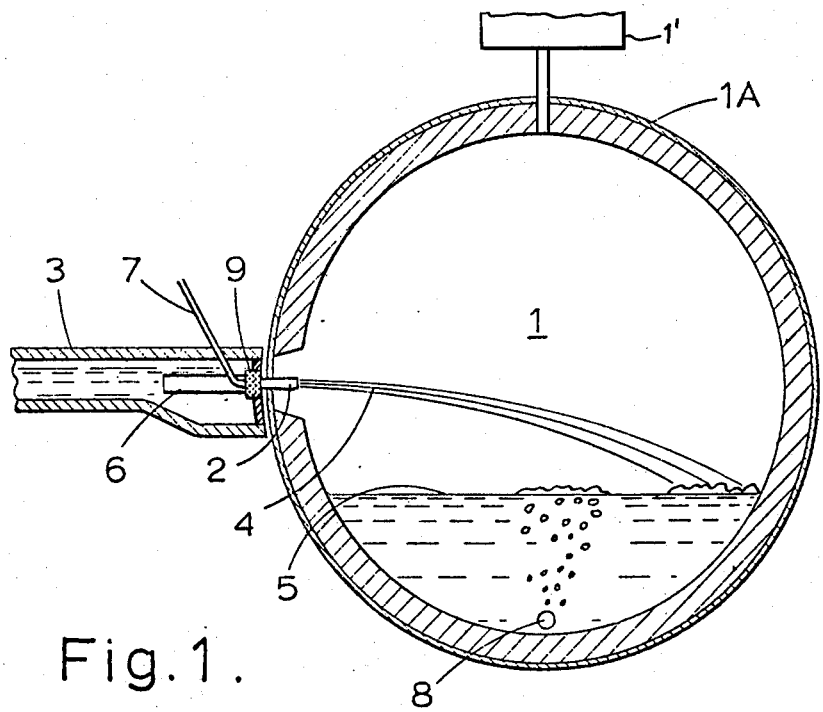
FIG. 1 shows a simplified vertical section of a first apparatus for carrying out the invention.

In FIG. 1 there is shown a vacuum furnace 1A with a vacuum chamber 1 adapted to be evacuated by means of pump equipment 1'. The vacuum furnace 1A further comprises means for the heating thereof, the heating means being not shown in the drawing since such means as well as the pump equipment may be of conventional construction and arrangement. Molten aluminum is supplied to the furnace 1A by means of a transfer channel 3 carrying molten aluminum metal from for instance holding or mixing furnaces, from crucibles or transferring raw electrolytic metal directly to the vacuum furnace.

The transfer channel 3 feeds the metal to one or more nozzles 2 opening into the furnace chamber 1 under (a) certain angles to the vertical and horizontal planes, (b) a certain level above the bottom of the chamber, (c) a certain level above the metal surface corresponding to a maximum metal content in the chamber, in such a way that the metal jet will have a close to optimum average length during the vacuum treatment, with respect to degassing and reduction of sodium and non-metallic particles and impurities, at the same time as the composition and flow pattern of the jet — determined by the inner diameter, length and shape of the suction nozzles as well as the pressure in the vacuum chamber — and the direction of the jet result in the desired amount of stirring in view of the dissolving and alloying of alloying elements introduced into the empty vacuum furnace before the vacuum treatment takes place. The alloying elements can be in solid form, possibly as pre-alloys.

The structure and arrangement of the apparatus will to some degree be related to the geometry of the vacuum chamber, as discussed in the description of FIG. 2 below.

Figure 3:
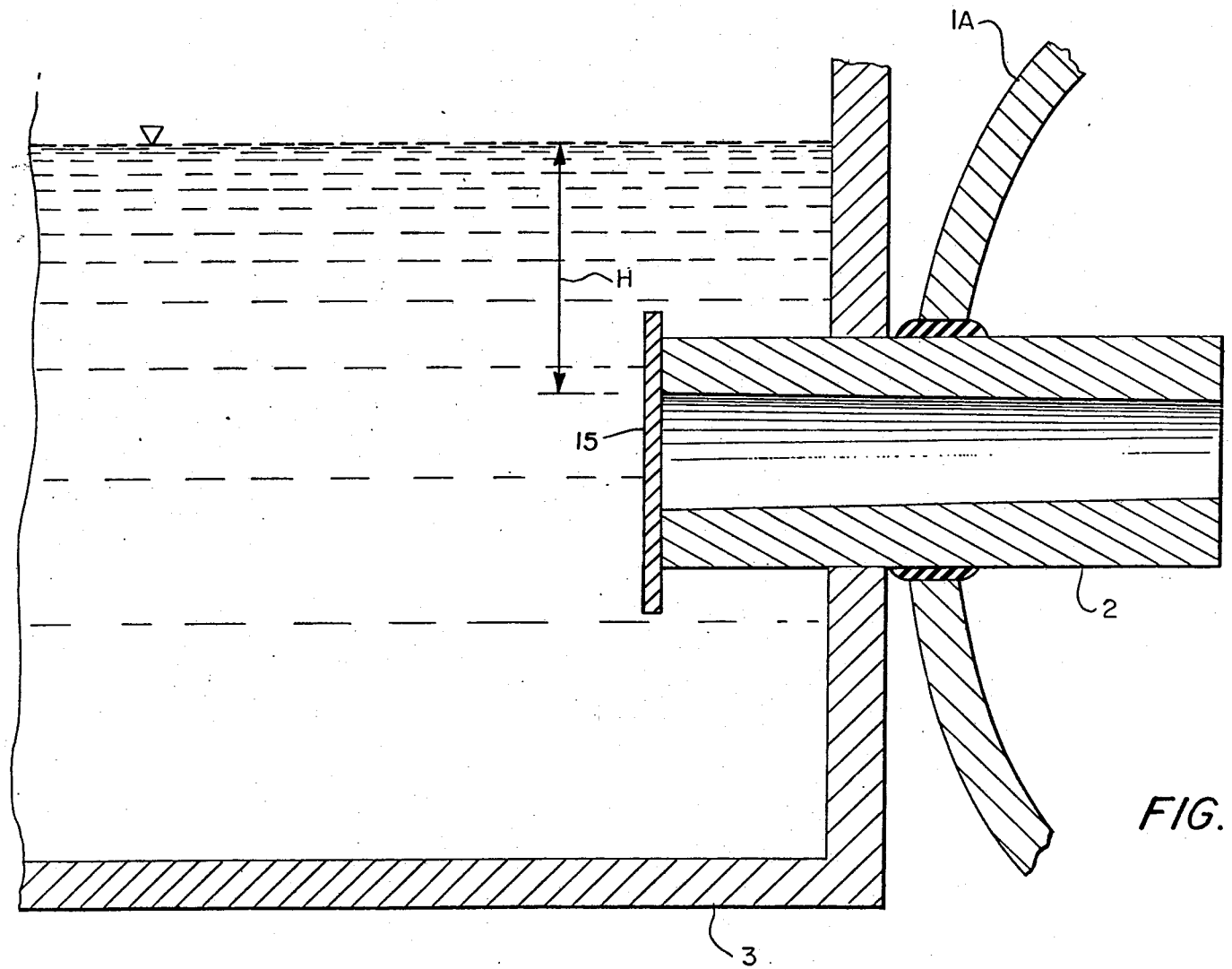
FIG. 3 is an enlarged sectional view of the nozzle.

The method of carrying out vacuum treatment with the apparatus thus far described consists therein that the desired known alloying elements, such as Mg, Fe and Si, in pure metallic solid form or as pre-alloys are charged into the empty vacuum chamber or furnace. Thereafter aluminum melt is introduced into the transfer channel 3 towards the nozzles 2 being at first blocked until the metal level in the transfer channel has reached a suitable level, preferably a distance H, as shown in FIG. 3, from 10 to 30 cm higher than the upper edge of the inlet opening to the nozzles, whereupon the nozzles are opened and the metal is sucked into the pre-evacuated chamber 1 in such a way that from each nozzle 2 there is ejected a jet of molten aluminum metal into the chamber. It is preferred to keep the level of molten aluminum in the transfer channel 3 in front of the nozzles 2 as much as possible constant at the above discussed level.

When the jet of aluminum melt is drawn into the evacuated furnace chamber, there will be an almost momentaneous degassing at the same time as the contents of sodium and non-metallic impurities is strongly reduced. At the same time the jet has such composition and flow pattern and such velocity and direction that the alloying elements, having been brought into the vacuum furnace beforehand, are easily dissolved and mixed into the melt so that the desired alloy quality is ready for casting immediately after termination of the vacuum treatment. The possible addition of a grain refiner can take place in the transfer channel 3 in front of the suction opening or nozzles 2 during the dynamic vacuum treatment. The grain refiner can also be added on beforehand into the vacuum chamber.

Moreover, there can as known per se, be introduced non-reactive gases in the aluminum melt during the vacuum treatment. Thus, non-reactive gas can be introduced in a way not shown above the melt bath in the chamber 1, through the melt bath by means of feed holes 8 as indicated in the drawing, or through lances, at the bottom of the furnace 1A, or in the nozzles 2 by means of feed tubes 7 terminating in each of the nozzles.

The non-reactive gas introduced mainly serves as a transport gas for vaporized sodium at the same time as the reduction in the content of hydrogen and non-metallic particles is also improved.

When treating strongly contaminated metal there can additionally be provided a filter unit 6 closely connected to the suction nozzles 2. The filter unit 6 is located in the transfer channel 3 outside the vacuum chamber 1 and consists of one or more tubes with an open end closely connected to the suction nozzle 2. The filter tubes are manufactured of refractory material and have a certain porosity so that the metal by means of the reduced pressure in the vacuum chamber, is drawn through the tube walls.

Before suction of the melt into the chamber 1 the suction opening of each nozzle 2 is kept closed with a seal 9 comprising a sealing material adapted to melt or burn under the influence of the molten aluminum in the transfer channel 3 when the melt has attained a desired level therein, whereby the nozzle openings are unblocked and suction into the chamber 1 can take place. The sealing material can for instance be an organic material capable of being ignited and burned under the influence of the molten aluminum when it has attained the desired level, or the material can be a metal, for instance aluminum with a suitable melting temperature. The sealing arrangement can also be provided in a simple way by arranging a sealing material as for instance asbestos or foam rubber sheet as a gasket between the suction inlet opening and a metal plate, such as shown by 15 in FIG. 3. When the transfer channel 3 has been filled the vacuum treatment starts by moving the metal plate 15 to the side. This arrangement is employed when the above mentioned filter unit is used in front of the suction opening.

Figure 2:
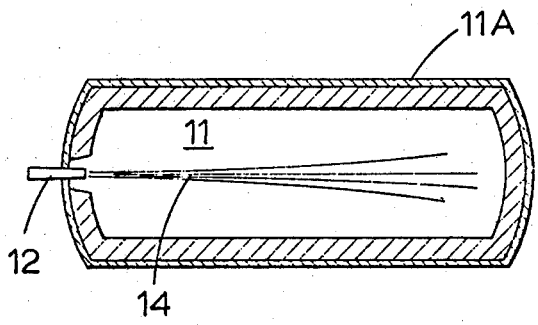
FIG. 2 shows also simplified a horizontal section of another embodiment of an apparatus for carrying out the invention.

FIG. 2 shows an advantageous arrangement of nozzles 12 in an elongated furnace 11A. In order to obtain a long jet 14 in the chamber 11 the nozzles 12 are located in an end wall of the furnace, which can for instance have a cylindrical main shape.

As described above, the result of the dynamic vacuum treatment is to a large degree determined by a number of parameters and the nutual relationship thereof. The best result has been obtained with parameters within the ranges below:

Nozzle diameter: 20–55 mm
Average jet length: 800–1800 mm
Nozzle length: 15–300 mm
Nozzle taper: 2°
Angle of nozzle to the horizontal plane: 3°–20°
Temperature: 680°–780° C
Pressure in the vacuum chamber: less than 20 TORR It will be understood that the above method and apparatus can be modified within given ranges and in various ways without departing from the scope of this invention.

The advantages obtained by using the teaching of this invention can in short be summed up as follows:

An almost instantaneous degassing and reduction in contents of finely dispersed oxide and other non-metallic particles in the melt occurs at the same time as the melt is alloyed to the desired alloy quality.

A good stirring with an even distribution of the alloying elements results.

A drastic reduction in the contents of sodium in the melt results.

A high yield of added alloying elements is obtained.

A small dross loss occurs.
An increased melt treating capacity is obtained.
An increased productivity results.
A strong reduction in the consumption of pre-alloys is obtained.
Stirring tools and stirring therewith, which contaminate the melt, for instance iron impurities in high brilliance alloys, are eliminated.

The following examples are given to additionally illustrate the invention and refer to the following parameters of the apparatus used for the dynamic vacuum treatment:

Nozzle diameter: 35 mm
Nozzle length: 170 mm
Nozzle angle to the horizontal plane: 6°
Average jet length: ca. 1000 mm
Vacuum chamber shape: Horizontal cylinder with an inner diameter of about 2400 mm
Pressure in the vacuum chamber: less than 10 TORR
Capacity of the vacuum chamber: 20 metric tons.

The examples refer to the treatment of primary or raw metal.

EXAMPLE 1

Alloy quality 50-S (450 metric tons).
Analysis: Fe 0.19 - 0.24%, Mg 0.43 - 0.47%, Si 0.48 - 0.52%, the balance aluminum.
Reduction:
Hydrogen 45%
Oxygen 50%
Non-metallic inclusions: ab. 50%.
Final level:
Hydrogen: 0.12 ± 0.02 ml $H_2$/100 g Al N.T.P (1S)
Oxygen: 6 ± 1.5 ppm O (1S)
Yield of alloying elements substantially equal to 100%.
Loss of Mg unrecordable by spectrographic analysis.
No introduction of non-reactive gas. Average capacity: Ab. 1 metric ton per min.

EXAMPLE 2

Alloy AlMg5 (5% Mg). (100 metric tons).
Introduction of non-reactive gas.
Final level:
Hydrogen: 0.12 ml $H_2$/100 g Al N.T.P.
Sodium: 3 ppm.
Reduction of non-metallic particles: Ab. 40%
Negligible loss of Mg.

EXAMPLE 3

Metal quality 99.50% Al. (600 metric tons).
No introduction of non-reactive gas.
Final level:
Hydrogen: 0.10 ± 0.03 ml $H_2$/100 g Al N.T.P.
Oxygen: less than 1.5 ppm O.
Reduction of non-metallic particles: Ab. 45%.

EXAMPLE 4

Alloy quality AlMg2 (2% Mg). (200 metric tons).
Introduction of non-reactive gas.
Final level:
Hydrogen: 0.06 ml $H_2$/100 g Al N.T.P.
Sodium: less than 3 ppm.
Negligible loss of Mg.

What is claimed is:

1. Apparatus for use in the batch production of light metal alloys, said apparatus comprising a vacuum furnace with a vacuum chamber, said vacuum chamber having a completely closed bottom wall, means for evacuating said vacuum chamber, and nozzle means for introducing molten light metal into said vacuum chamber by suction, said nozzle means comprising at least one nozzle for forming at least one free-falling jet of molten light metal in said vacuum chamber, said at least one nozzle being directed into said vacuum chamber at an angle with the horizontal plane in the range of from 3° to 20°.

2. Apparatus according to claim 1, in which the width of the nozzle openings are in the range of from 20 to 55 millimeters.

3. Apparatus according to claim 1, in which the average length of the jet in the vacuum chamber during the vacuum treatment is within the range of from 80 to 180 centimeters.

4. Apparatus according to claim 1, in which the length of said at least one nozzle is within the range of from 50 to 300 millimeters.

5. Apparatus according to claim 1, wherein said at least one nozzle has an inlet opening, and further comprising means for maintaining said inlet opening closed before the introduction by suction of said molten metal, said means comprising a seal of sealing material adapted to be destroyed under the influence of said molten metal when the melt has attained a desired level, whereby the nozzle openings are unblocked and suction into the chamber can take place.

6. Apparatus accordingly to claim 5, in which said sealing material is an organic material capable of being ignited and burning under the influence of the melt when a desired level thereof is attained.

7. Apparatus according to claim 5, in which said sealing material is a metal, for instance aluminum, with a suitable melting temperature so that it melts under the influence of the melt when a desired level is attained.

8. Apparatus according to claim 1, in which said inlet opening to each nozzle is maintained closed before the suction by a displaceable plate adapted to be removed when the melt has attained a desired level and the suction can start.

9. Apparatus according to claim 1, further comprising a feed tube for non-reactive gas adapted to terminate in each nozzle.

10. Apparatus according to claim 1, further comprising a filter unit consisting of at least one tube of refractory porous material arranged in a transfer channel in front of said at least one nozzle, the open end of said tube being tightly connected to said nozzle so that the molten metal is sucked by the vacuum effect and thereby filtered through the porous wall surfaces of the tubes.

11. Apparatus according to claim 1, wherein said vacuum chamber has an elongated shape, said at least one nozzle being arranged in one end wall thereof so that the jets extend generally in the longitudinal direction of said chamber.

* * * * *

UNITED STATES PATENT AND TRADEMARK OFFICE

CERTIFICATE OF CORRECTION

PATENT NO. : 4,049,248

DATED : September 20, 1977

INVENTOR(S) : Ole Georg GJOSTEEN ET AL.

It is certified that error appears in the above-identified patent and that said Letters Patent are hereby corrected as shown below:

On the first page, insert the following:

-- FOREIGN APPLICATION PRIORITY DATA

July 16, 1971 Norway.....2730/71

May 5, 1972 Norway.....1607/72 --.

Signed and Sealed this

*Eleventh* Day of *November 1980*

[SEAL]

*Attest:*

*Attesting Officer*

SIDNEY A. DIAMOND

*Commissioner of Patents and Trademarks*